United States Patent [19]

Giroud

[11] 4,139,154

[45] Feb. 13, 1979

[54] RAIL FOR CENTER-FLANGE WHEELS

[76] Inventor: Gerard Giroud, 36, rue de Teeside, Dunkerque, France, 59240

[21] Appl. No.: 760,827

[22] Filed: Jan. 21, 1977

Related U.S. Application Data

[63] Continuation-in-part of Ser. No. 590,860, Jun. 27, 1975, abandoned.

[30] Foreign Application Priority Data

Jul. 12, 1974 [FR] France ..... 74 24207

[51] Int. Cl.[2] ..... E01B 5/04; E01B 21/00

[52] U.S. Cl. ..... 238/136; 238/122; 238/137; 238/141; 238/142; 238/148; 295/34

[58] Field of Search ..... 238/22, 23, 122, 123, 238/127, 128, 129, 131, 136, 137, 141, 142, 148, 149; 104/1 A, 107, 108, 109, 118, 120, 126; 295/4, 8.5, 31 R, 33, 34

[56] References Cited

U.S. PATENT DOCUMENTS

| | | | |
|---|---|---|---|
| 402,022 | 4/1889 | Knapp | 238/122 |
| 574,599 | 1/1897 | Caldwell et al. | 238/122 |
| 591,597 | 10/1897 | Galbreath | 238/128 |
| 695,138 | 3/1902 | Beecher | 238/122 |

FOREIGN PATENT DOCUMENTS

| | | | |
|---|---|---|---|
| 813037 | 9/1951 | Fed. Rep. of Germany | 238/129 |
| 1201025 | 9/1965 | Fed. Rep. of Germany | 104/126 |
| 6347 | 2/1851 | France | 238/128 |
| 3291 of | 1867 | United Kingdom | 238/122 |
| 22504 of | 1907 | United Kingdom | 295/33 |
| 400911 | 4/1932 | United Kingdom | 238/142 |

*Primary Examiner*—L. J. Paperner
*Assistant Examiner*—Randolph A. Reese
*Attorney, Agent, or Firm*—George H. Mitchell, Jr.

[57] ABSTRACT

The present invention relates to a rail intended to constitute a tread for heavy duty rolling stock, such as gantry cranes, mounted on wheels or rollers and concerns more specifically a guide rail on which both center-flange wheels or rollers, and lateral-flange wheels, as used on railway lines roll, comprising, in section, two integrally formed spaced heads running parallel to each other, the two heads having vertical inner side walls and being separated by a horizontal intermediate channel whose bottom constitutes a horizontal connecting strip.

3 Claims, 4 Drawing Figures

RAIL FOR CENTER-FLANGE WHEELS

Figure 1:
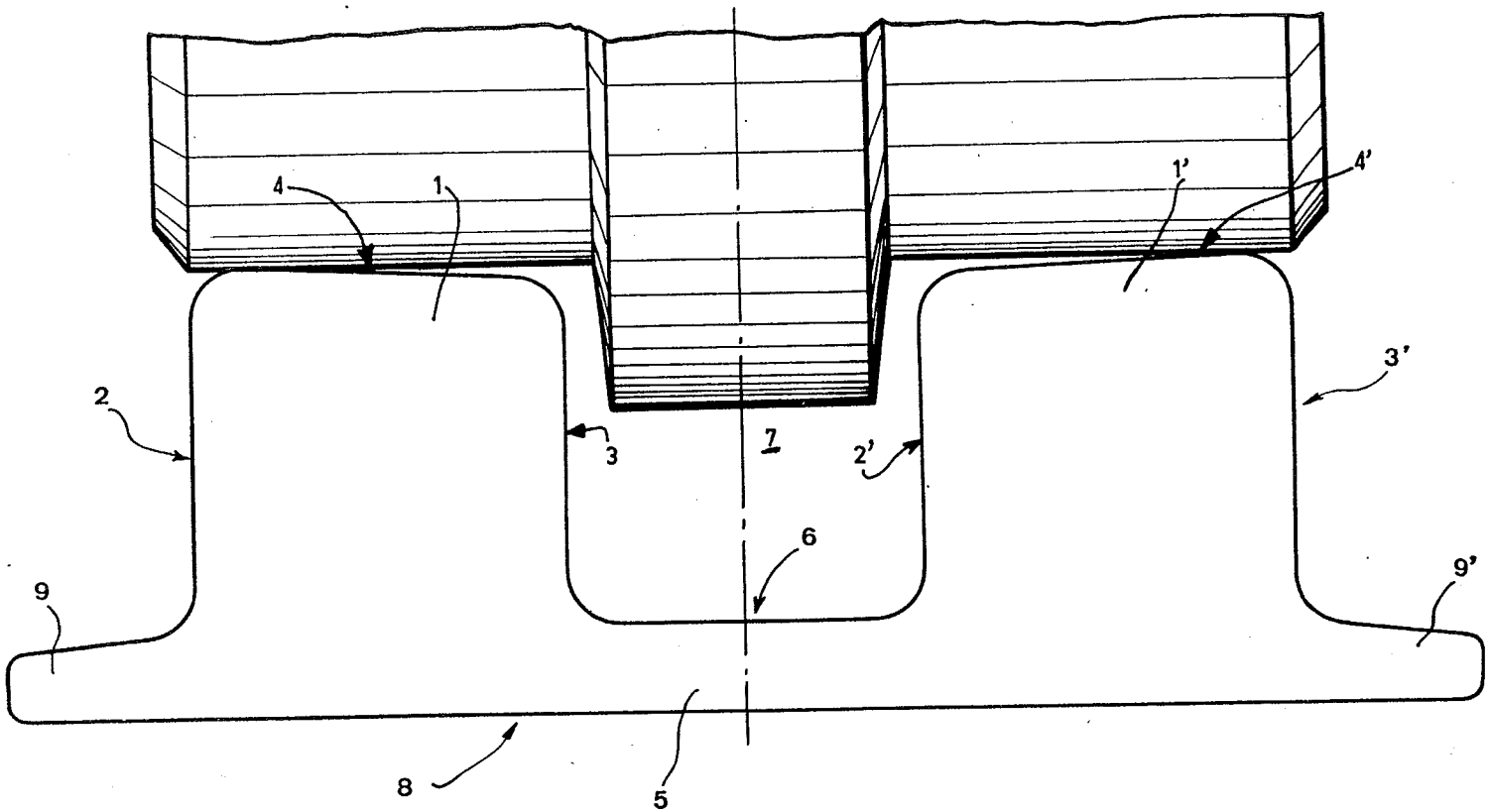

This application is a continuation-in-part of my prior application Ser. No. 590,860, filed June 27, 1975, now abandoned.

The present invention relates to a rail section intended to constitute a tread for rolling stock, such as a gantry crane, mounted on wheels or rollers.

Conventional rails are constituted by a generally I-shaped section; the vertical central web rests on a horizontal lower base and it supports a head whose upwardly turned upper horizontal surface constitutes the rail tread receiving the wheel or the roller of the vehicle moving on said rail.

For particular applications, for example, for receiving center-flange rollers, guide devices are known for supporting these rollers, which are constituted by rails coupled in parallel; these two rails, connected together by crosspieces, or like fixing means, thus offer two parallel treads defining a gap therebetween for receiving the flange guiding the rollers, the two edges of which, on either side of the guide flange, rest on each of the two coupled rails.

This device means that two different rails have to be connected together, and this work is delicate in view of the strict alignment and spacing which has to be maintained between the rails. A rail of this type is shown in French Pat. No. 1,350,712.

For other applications, particularly for railway lines embedded on a road-bed, rails are also known, which comprise, next to the head constituting the thread, a strip or longitudinal web parallel to the head and separated therefrom by a channel, said strip or longitudinal web being substantially level with the surface of the road-bed, the ensemble thus being embedded in the surface of the ground whilst ensuring the protection of the channel receiving the flange of the wheel.

However, these rails with protected channel, intended to be embedded, are conventionally mounted on a vertical web, itself resting on a horizontal base; the rails of this type, embedded in a road-bed, must therefore be embedded deeply and considerable excavation work must be carried out to remove and replace them. A rail of this type is disclosed in British Specification No. 400,911.

The invention aims at remedying these various drawbacks and seeks to provide a guide rail that may be used both for a centerflange roller or a lateral-flange wheel of the railway wheel type; to this end, the invention relates to a guide rail on which centerflange wheels or rollers or lateral-flange wheels as used on railway lines roll, wherein it is constituted by a section comprising two heads forming two treads parallel to each other, the two heads being separated by and integral with an intermediate channel whose bottom constitutes a horizontal strip connecting said treads.

The two heads connected by the connecting strip constituting the center of the central channel rest on a horizontal base on which each head rests directly, the base projecting laterally with respect to the vertical from the outer side edge of each of the heads.

Under these conditions, the double-headed rail does not comprise a vertical web, the two heads connected together by a horizontal strip resting directly on a common sole piece forming a base and projecting laterally with respect to the overall width of the rail at the level of the two coupled heads.

In accordance with the first embodiment of the invention, the section of the two-headed rail is symmetrical in a median plane passing through the center of the intermediate channel.

In this embodiment, a double tread is thus obtained which may in particular receive a center-flange wheel or roller, the guideflange penetrating into the intermediate channel and the cylindrical surfaces of the roller, on either side of the flange, bearing on the symmetrical twin treads constituted by the two heads.

According to another feature of the invention, the heads are generally quadrangular in section and comprise a substantially horizontal upper surface and two substantially vertical side walls, the whole resting on the lower horizontal base.

Several advantages result from this design, and they result from the fact that when a rail is intended to support heavy gantry cranes used for loading, or unloading, of ships tied up to dockside, the crane rolls along the track only for the purpose of changing its position with respect to the unloading operation.

The main function of a crane is not to roll along the track, but to load and unload cargo between two positions located transversely with respect to the length of the track. Rolling along the track is a secondary operation, allowing the crane to move between successive loading, or unloading, operations, and it is estimated that the time spent in thus shifting from one location to another occupies not more than about one to two percent of the working time of the apparatus.

Thus, during between 98% and 99% of the time, the rail which is the subject of this invention, must serve as a supporting base for a crane which must remain in a fixed position while shifting heavy loads between locations transverse to the rail. For this reason, a rail of the type disclosed in U.S. Pat. No. 591,597, to Galbreath, or British Specification No. 400,911 is unsuitable because, in each case, the overhang of the treads with respect to their vertical supporting webs introduces an undesirable bending force which requires an excessively massive construction. In the case of a rail of the type disclosed in U.S. Pat. No. 574,599, issued to Caldwell et al., in which the upper surfaces of the two treads are inwardly and downwardly inclined to increase the rolling traction of a similarly beveled wheel, the continuous vertical weight, such as would be applied by a crane during its working period, would produce forces tending to split the rail apart.

In addition, during the extended periods of time when a crane is working, some means is required to anchor the crane in place along the rail while this is taking place, otherwise, it might tend to roll along the track while transporting heavy loads. It must also be borne in mind that the rail must be embedded in the ground with the tread level with the surrounding surface to allow for movement of other types of surface vehicles.

For this reason, any blocking system used to anchor the crane in place cannot grip the outer sides of the rail in the manner of pincers; the braking means can only act on the inner walls of the two spaced rail heads.

In one form of brake, a member, whose length is slightly longer than the width of the space between the rail heads, is laid in the central channel formed by the heads in a diagonal direction and then is turned by means of an extension handle to wedge the braking member in place. Another type of brake consists of a pair of pivoted arms comprising a lever of the first class. One end of the brake is inserted downwardly into the channel and, when the upper ends are spread apart, as by means of a hydraulic jack, the lower ends become wedged between the rail heads.

Obviously, either one of these braking system exerts a strong horizontal force on the rail heads, which tends to eventually loosen the rails when two separate rails are used to support the rollers. On the other hand, in the integrally formed rail of the present invention, the transverse forces are easily resisted. However, in order to accommodate a braking device of the type described, the inner side walls of the two treads must be substantially vertical, as in the present invention, or else they would slip out of place. For this reason, rails having sloping inner walls, as disclosed in the British Specification No. 3,291 of 1867 and the U.S. Pat. No. 574,599, are not suitable.

According to a variant embodiment, the side walls of each of the heads are slightly inclined, each head thus being generally trapezoidal in section, the small base thereof, at the top, is slightly narrower than the large base, at the bottom.

In accordance with yet another variant embodiment, the base comprises on its lower face a central longitudinal recess located beneath the channel, the base thus being constituted by two rest surfaces or seatings, each located in vertical alignment with one of the heads, the two heads being connected together by the horizontal strip whose upper face constitutes the bottom of the intermediate channel and whose lower face forms the bottom of the recess separating the two supporting side surfaces of the base, the ensemble having the general form of an H.

The invention will be more readily understood on reading the following description given with reference to the accompanying drawings, in which:

Each of FIGS. 1–4 is a view in transverse section of a rail in accordance with the invention, each showing an example of a section coming within the scope of the present invention.

Referring now to the drawings, FIG. 1 shows the rail according to the invention constituted by two symmetrical heads 1 and 1' with vertical side walls 2, 2' and 3, 3'; the upper surface 4, 4', constituting the rail tread of each of the heads, is in this case slightly inclined towards the center; the two heads are connected by the horizontal strip or zone 5 whose upper surface 6 constitutes the center of the central or intermediate channel 7 and, as can be seen in the drawing, each of the heads forms a solid mass of generally square cross-section.

In this example, the horizontal strip 5 constitutes the central element of the base 8 on which the two heads 1 and 1' directly rest, without the interpositioning of a vertical web; the lateral projections 9, 9' in line with the central strip 5 increase the lateral seating of the rail and enable it to be fixed in known manner by means of sleeper screws or clips.

Figure 2:
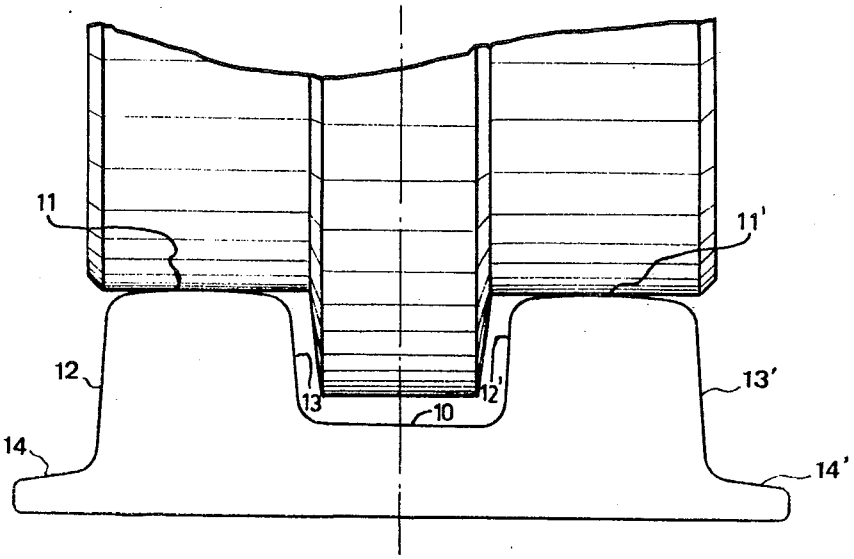

FIG. 2 shows a variant of FIG. 1 in which the central strip 10 connecting the two heads 11 and 11', which are still symmetrical, is slightly thicker than in the preceeding example; furthermore, the side walls 12, 12' and 13, 13' of each of the heads 11, 11' are slightly inclined with respect to the vertical, the section of each head being an isosceles trapezium whose small base, at the top, is slightly shorter than the large base, at the bottom.

Here, the base is one piece and forms a continuous surface between the two side projections, 14, 14'.

Figure 3:
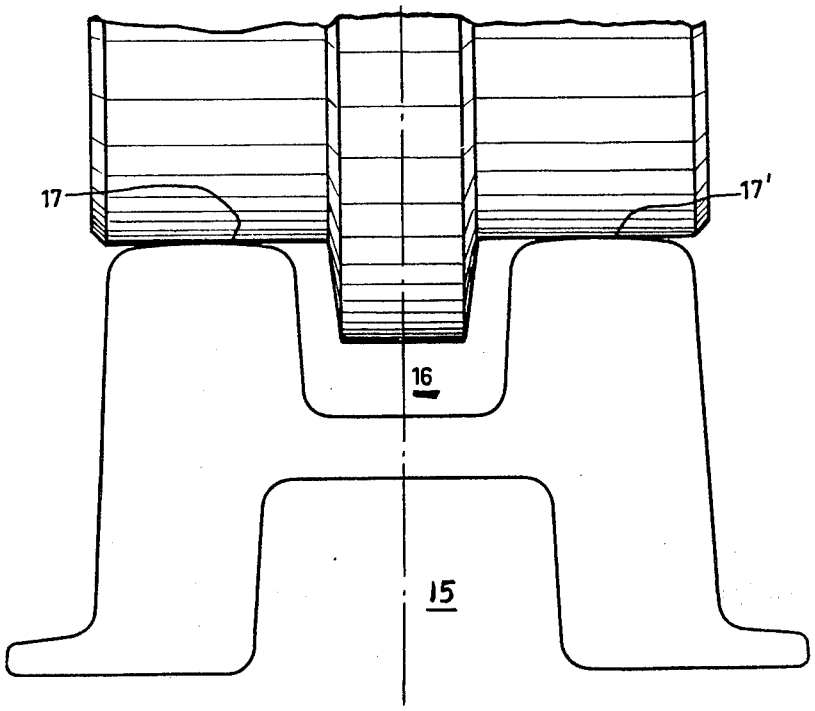
Figure 4:
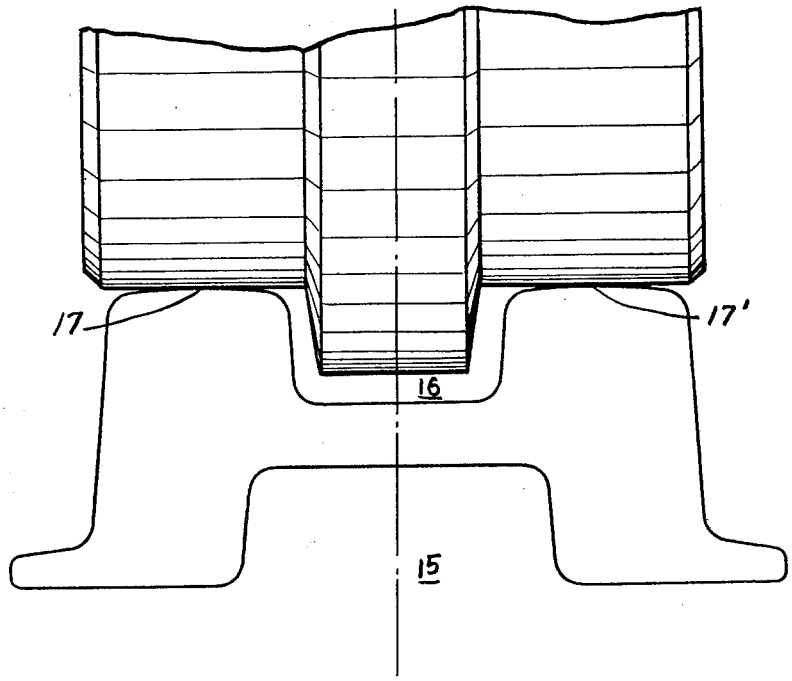

In the examples of FIGS. 3 and 4, the base comprises in its longitudinal median axis a recess 15 located directly beneath the upper intermediate channel 16 separating the two heads, 17, 17', the upper surfaces of which may be substantially horizontal, rather than slightly inclined. As the drawings indicate, in this case the height of each head is no more than twice its own width and each forms with its associated base portion a generally rectangular mass in cross-section.

The extreme width of the base of the rail of this invention as compared to the height of the rolling surfaces provides for an exceptionally solid seating of the rail, regardless of the support to which it is attached.

Furthermore, since the wheels, or rollers, of large gantry cranes are usually individually driven, and are not mounted in pairs on common transverse axles, there is sometimes a tendency for a crane to run in a skewed direction, if the wheels on one side turn at a different speed than those on the other side. For this reason, it will be observed that the distance between the inner surfaces of the rail heads is sufficient to allow a fairly large clearance for the center flange of a roller so that in the event there is a certain amount of skewing during movement along the track, the crane will not be derailed.

Finally, since the distance between a pair of rails for supporting a gantry crane may be in the neighborhood of ten meters, more or less, it is difficult, when laying the rails, to accurately space them apart an exact distance along their entire length. Therefore, the wide clearance between the center flange and the two rail heads permits a certain amount of unintentional variation in the spacing of the rails without causing unsatisfactory service.

What is claimed is:

1. A roadbed for heavy hoisting machinery such as a crane, or a gantry crane, mounted on at least one pair of flanged wheels for movement of the crane between hoisting positions and for supporting the crane in a fixed position on the roadbed when engaged in said hoisting, said roadbed being provided with a railway line formed of two parallel rails spaced apart at a distance of at least 5 meters, the upper surfaces of said rails lying flush with the surface of the roadbed to permit the passage of other vehicles, each of said rails comprising;

two heads, the upper surfaces thereof forming two parallel, laterally-spaced treads to receive the rolling surface of a wheel;

and, a horizontal strip integrally joined to said heads below the level of the flange of a wheel rolling on said treads;

the space between the heads and the horizontal strip defining an intermediate channel to freely receive the tapered flange of the wheel normally without frictional engagement to allow for some lateral shifting of the wheel and possible misalignment between the two rails;

each of said heads defining inwardly-facing inner side walls and external outwardly-facing side walls said inner and external side walls of the two heads being substantially vertical;

and a horizontal integrally formed base to support the two heads, the height of said external side walls being substantially equal to the width of each of the heads, each of the two heads thus forming a solid mass of generally square cross-section each resting on said horizontal base, said base extending outwardly beyond said outwardly-facing side walls, the upper exterior surfaces of the base defining with said external side walls an angle of no less than 90°;

the vertical side walls of the heads permitting vertical forces on the treads to be transmitted directly downwardly to the base without any twisting or buckling effect on the heads.

2. A rail according to claim 1, wherein the upper surface of each head is slightly inclined toward the center so as to cause the rolling surface of the wheel to rest on the tread along the external part thereof.

3. A roadbed for heavy hoisting machinery such as a crane, or a gantry crane, mounted on at least one pair of flanged wheels for movement of the crane between hoisting positions and for supporting the crane in a fixed position on the roadbed when engaged in said hoisting, said roadbed being provided with a railway line formed of two parallel rails spaced apart at a distance of at least 5 meters, the upper surfaces of said rails lying flush with the surface of the roadbed to permit the passage of other vehicles, each of said rails comprising;

two heads, the upper surfaces thereof forming two parallel, laterally-spaced treads to receive the rolling surface of a wheel;

and, a horizontal strip integrally joined to said heads below the level of the flange of a wheel rolling on said treads;

the space between the heads and the horizontal strip defining an intermediate channel to freely receive the tapered flange of the wheel normally without frictional engagement to allow for some lateral shifting of the wheel and possible misalignment between the two rails;

each of said heads defining inwardly-facing inner side walls, said inner side walls of the two heads being substantially vertical and the upper surface of said strip being horizontal;

each of said heads further defining external outwardly-facing side walls, said external side walls of the two heads being slightly outwardly and downwardly inclined;

and a horizontal integrally formed base to support the two heads, the outwardly-facing side walls of the base being a continuation of the inclined outwardly-facing side walls of the heads and each of said heads and associated base portion having a height no more than twice the width of each head and defining a generally rectangular mass in cross-section, tbe lowermost portions of the base projecting outwardly beyond said outwardly-facing side walls;

said base being provided with an upwardly extending central recess of generally rectangular cross-section, the upper end of the recess being horizontal and defining the bottom of said horizontal strip joining the two heads, the width of the recess being approximately the width of the space between the inwardly-facing side walls of the heads and in vertical alignment therewith;

whereby vertical forces on the two heads are transmitted directly downwardly to the base without a twisting or buckling effect and transverse forces due to possible misalignment of a rail is resisted.

* * * * *